US007654629B2

(12) United States Patent
Grosse et al.

(10) Patent No.: US 7,654,629 B2
(45) Date of Patent: Feb. 2, 2010

(54) CARRIAGE POSITIONING

(75) Inventors: Jason C. Grosse, Vancouver, WA (US); Rick M. Tanaka, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 315 days.

(21) Appl. No.: 11/494,214

(22) Filed: Jul. 27, 2006

(65) Prior Publication Data

US 2008/0024540 A1 Jan. 31, 2008

(51) Int. Cl.
*B41J 29/393* (2006.01)

(52) U.S. Cl. ..... 347/19; 347/37; 347/39

(58) Field of Classification Search ..... 711/4
See application file for complete search history.

(56) References Cited

U.S. PATENT DOCUMENTS

| | | | | |
|---|---|---|---|---|
| 3,858,703 | A | 1/1975 | Duley | |
| 3,910,396 | A | 10/1975 | Eischen | |
| 3,970,183 | A | 7/1976 | Robinson | |
| 4,064,983 | A | 12/1977 | Inose | |
| 4,179,223 | A | 12/1979 | Kwan | |
| 4,204,777 | A | 5/1980 | Jen | |
| 4,208,137 | A | 6/1980 | Liu | |
| 4,281,938 | A | 8/1981 | Phillips | |
| 4,435,674 | A * | 3/1984 | Hevenor et al. | 318/640 |
| 4,533,268 | A | 8/1985 | Sanders | |
| 4,786,803 | A | 11/1988 | Majette | |
| 4,847,633 | A | 7/1989 | Platt | |
| 4,914,437 | A * | 4/1990 | Kibrick et al. | 341/3 |
| 5,392,244 | A * | 2/1995 | Jacobson et al. | 711/114 |
| 5,676,475 | A | 10/1997 | Dull | |
| 5,852,459 | A | 12/1998 | Pawlowski | |
| 6,140,636 | A | 10/2000 | Norton | |
| 6,254,292 | B1 | 7/2001 | Navarro | |
| 6,267,466 | B1 | 7/2001 | Gudaitis | |
| 6,352,332 | B1 | 3/2002 | Walker | |
| 6,428,879 | B1 | 8/2002 | Hansel | |
| 6,616,263 | B2 | 9/2003 | Allen | |
| 6,623,096 | B1 | 9/2003 | Castano | |
| 6,659,578 | B2 | 12/2003 | Gudaitis | |
| 6,822,220 | B2 | 11/2004 | Lesniak | |
| 2006/0181570 | A1 | 8/2006 | Grosse | |
| 2006/0284906 | A1 * | 12/2006 | Jeong et al. | 347/5 |

FOREIGN PATENT DOCUMENTS

| | | | |
|---|---|---|---|
| JP | 02179779 | A2 | 7/1990 |
| JP | 2004351677 | A * | 12/2004 |

OTHER PUBLICATIONS

Human translation of JP 2004-351677 A. (Previously emailed to applicant's representative.).*

* cited by examiner

*Primary Examiner*—Matthew Luu
*Assistant Examiner*—Justin Seo

(57) ABSTRACT

Systems and methods are disclosed for carriage positioning.

20 Claims, 4 Drawing Sheets

CARRIAGE POSITIONING

BACKGROUND

Carriage position during inkjet printing may affect print quality. As such, maintaining accurate carriage position may benefit print quality in some applications. Determining carriage position, however, in some configurations, may be time consuming and cumbersome.

DETAILED DESCRIPTION

Figure 1:
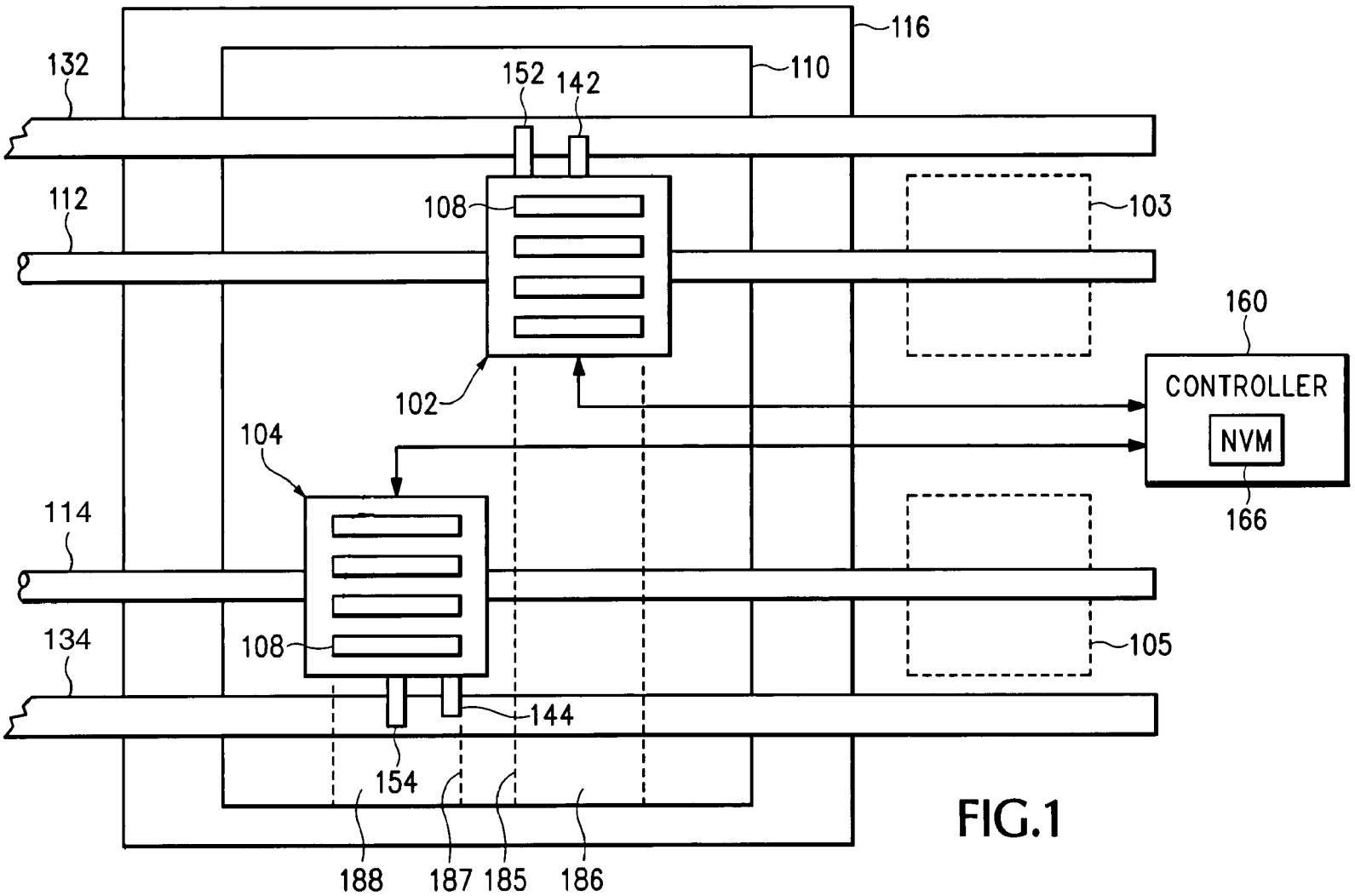
FIG. 1 illustrates an example embodiment of a system.

FIG. 1 illustrates an example embodiment of a system 100, which may comprise an inkjet printer, copier, or the like. The system 100 includes carriages 102, 104 slidably mounted on rods 112, 114, respectively. The carriages 102, 104 are configured to slide on the rods 112, 114 in directions 122, 124, respectively. The carriages 102, 104 each have one or more inkjet pens 108 mounted thereon and are configured to hold the pens 108 for printing. The inkjet pens 108 are configured to eject ink onto a print medium 110 for forming an image on the medium 110 as the medium 110 passes adjacent the pens 108. The pens 108 may also be referred to as "print cartridges" and may each contain one or more printheads. The medium 110 may comprise a sheet of paper or other suitable print medium.

In some embodiments, the medium 110 is positioned on a platen 116 during printing. Pursuant to the illustrated embodiment, the platen 116 comprises a rotating drum (FIG. 2) and the medium 110 is carried under the pens 108 by the platen 116 as the platen 116 rotates. The medium 110 may be secured to the platen 116 by vacuum, capacitance, grippers, or other suitable manner. Moreover, other suitable types of platens and media handing mechanisms may be alternatively employed.

Encoder strips 132, 134 (FIGS. 1, 3) are associated with carriages 102, 104, respectively. The carriage 102 includes sensors 142, 152 positioned to read markings on the encoder strip 132. Likewise, the carriage 104 includes sensors 144, 154 positioned to read markings on the encoder strip 134. In some embodiments, the sensors 142, 144 are analog encoder sensors configured to detect regularly-spaced encoder markings. In some embodiments, the sensors 152, 154 are opto-interrupter sensors configured to detect light-to-dark transitions. Other suitable sensors may alternatively be employed.

The carriage 104 also includes a sensor 120. The sensor 120 may comprise one or more image or light sensors on the carriage 104 and is configured to sense light reflected from the medium 110, the platen 116, or other structure beneath the carriage 108. In some embodiments, the sensor 120 comprises a set of color sensors. In other embodiments the sensor 120 may comprise a CCD sensor. Other suitable sensors may alternatively be employed.

A controller 160 controls operation of the device 100. The controller 160 controls positioning of the carriages 102, 104 via motors (not shown). The controller 160 also controls operation of the pens 108. In operation, the controller 160 uses information collected by sensors 142, 152 to position the carriages 102, 102, respectively. As shown, the controller 160 includes a non-volatile memory 166 for storing and reading position information for the carriages 102, 104, as described in more detail below.

Figure 2:
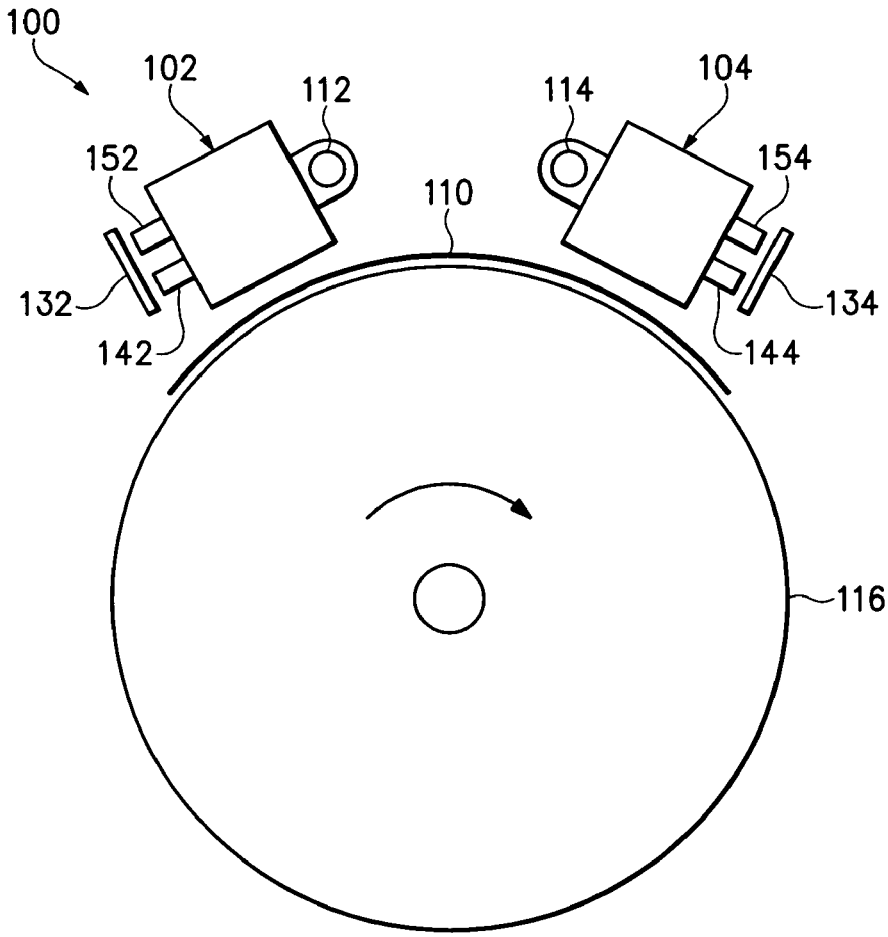
FIG. 2 illustrates another view of the system of FIG. 1.

FIG. 2 is a side elevation view of the system 100. In particular, FIG. 2 illustrates that the platen 116 may comprise a drum. Of course, other suitable media handling mechanisms or platens may be employed to advance the medium 110 relative to the carriages 102, 104.

Figure 3:
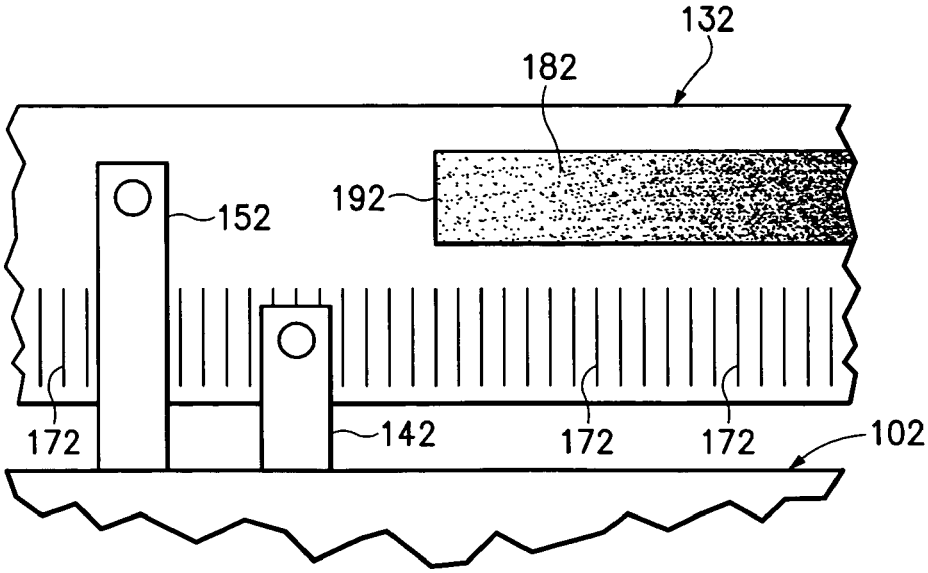
FIG. 3 illustrates details of an example encoder strip and sensors in accordance with an embodiment.

FIG. 3 illustrates a portion of the encoder strip 132 and a portion of the associated carriage 102. The encoder strip 132 includes encoder markings 172. The encoder markings 172 generally comprise a series or set of markings that are substantially equally spaced relative to each other and are configured such that they may be detected by the sensor 142. The sensor 142 optically detects the markings 172 as the carriage 102 moves relative to the encoder strip 132. The controller 160 (FIG. 1) receives data from the sensor 142 that is indicative of the extent to which the sensor 142 detects one of the markings 172. As such, as the carriage 102 moves relative to the encoder strip 132, the controller 160 can determine the distance moved by the carriage by the number of encoder marks 172 detected by the sensor 142. Further, the sensor 142 and the controller 160 may employ quadrature encoding techniques for determining carriage location. In some example embodiments, an analog interpolation encoding technique is employed to achieve high resolutions. For example, in some embodiments, the quadrature would result in $1/800$th inch resolution and the analog technique results in $1/230400$ inch resolution. Of course, other techniques and other resolutions may be alternatively employed.

The encoder strip 132 also includes marking 182. The marking 182 includes a light-to-dark transition 192 and end thereof. The marking 182 has a width that is more than 100 times the width of one of the markings 172. The sensor 152 is configured to detect the light-to-dark transition 192 as movement of the carriage 102 causes the sensor 152 to pass the light-to-dark transition 192. The controller 160 is configured to receive output from the sensor 152 such that the controller 160 receives a signal from the sensor 152 indicative of the sensor 152 passing the light-to-dark transition 192.

The encoder strip 134 of FIG. 1 is configured to be substantially identical to the encoder strip 132 such that encoder markings (not shown) on the encoder strip 134 are detected by sensor 144 and a light-to-dark transition (not shown) on the encoder strip 134 is detected by the sensor 154. The sensors 144, 154 are configured to send respective output signals to the controller 160.

With reference to FIG. 1 and in accordance with some embodiments, during printing, the pens 108 of the carriage 102 print swath 186 and the pens 108 of the carriage 104 print swath 188. As such, pursuant to these embodiments, the pens 108 of the carriage 102 print the subject matter for one portion of the medium 110 and the pens 108 of the carriage 104 print the subject matter for another portion of the medium 110.

Print quality may be affected by the relative positions of the swaths 186 and 188. In some applications, print quality is satisfactory when an inner edge 187 of the swath 188 is within a threshold distance from an inner edge 185 of the swath 186.

A suitable alignment procedure may be used to position the carriages 102, 104 such that the distance between the inner edges 185, 187 is sufficiently small, or within the threshold distance. These positions of the carriages 102, 104 are relative to a home or first position for each carriage. The home position 103 for carriage 102 is shown in dashed lines. Likewise, the home position 105 for carriage 104 is also shown in dashed lines.

One example alignment procedure is a print/scan procedure wherein the pens 108 of the carriages print alignment marks on a print medium. The sensor 120 then scans the print medium. Based on output from the sensor 120, the controller 160 determines alignment information for the carriages 102, 104 so as to ensure the distance between edges 185, 187 is less than the threshold distance.

When the controller 160 is power cycled, according to some embodiments, the controller 160 loses current position information for the carriages 102, 104. As such, after a power cycle, the controller 160 may determine the current positions of the carriages 102, 104. To avoid repeating the print/scan procedure described above, the carriages 102, 104 configured to have same or substantially same home positions as before the power cycle.

In general, and according to some example embodiments, the controller 160 initially determines a home position for each of the carriages 102, 104. The controller 160 then stores values associated with the home positions for the carriages 102, 104 in the non-volatile memory 166. The controller 160 then performs an alignment procedure to determine proper printing positions for the carriages 102, 104. This alignment procedure may be done by printing a test image or pattern on the medium 110 and then using the sensor 120 and the encoder strips 132, 134 to determine the relative positions of the inner edges 185, 187 of the swaths 186, 188. After a power cycle, the controller 160 determines home positions for the carriages 102, 104 and compares values associated with these home positions with the values stored in non-volatile memory. The difference between these values is added to the values of the newly-determined home positions so that the home positions after the power cycle and the home positions before the power cycle are close or identical.

For purposes of this disclosure "power cycle" means powering off the system 100 and then powering the system back on again. A power cycle may occur, for example, when a user turns off the system 100 and then turns the system on again. A power cycle may also occur, for example, when the system is disconnected from a supply of power, such as through an electrical outlet.

Figure 4:
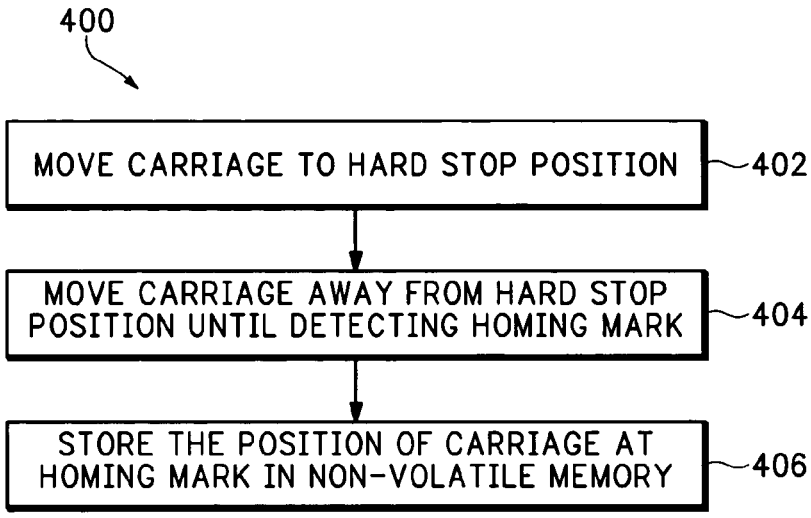
FIG. 4 is a flowchart illustrating a method for establishing a home position.

FIG. 4 is a flowchart 400 illustrating an example method for establishing a home position. This method is described with reference to the carriage 102, but this method is also applied to the carriage 104.

Initially, pursuant to block 402, the controller 160 (FIG. 1) moves the carriage 102 toward a surface 500 (FIG. 5) of a wall 502 until a surface 504 of the carriage 102 contacts the wall 502, thus stopping movement of the carriage 102 in that direction. This position of the carriage 102 is referred to as the "hard stop" position. In the hard stop position, the surface 504 of the carriage 102 contacts the surface 500 of the wall 502. In other embodiments, the carriage may contact different surfaces or different structures.

Figure 5:
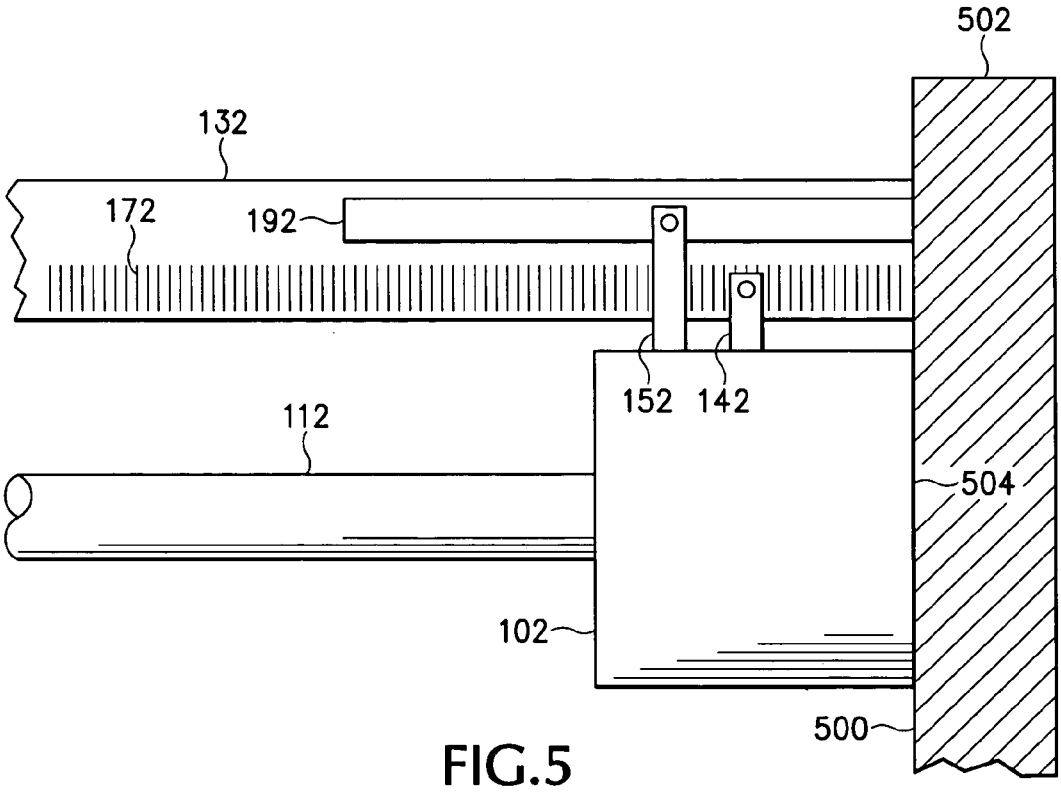
FIG. 5 illustrates a carriage at a hard stop position, according to an example embodiment.

Pursuant to some embodiments, the controller 160 determines that a carriage is in the hard stop position by moving the carriage 102 toward the surface 500 and then detecting a motor stall or otherwise detecting stoppage of the carriage 102. In FIG. 5, the carriage 102 is illustrated in the hard stop position.

Figure 6:
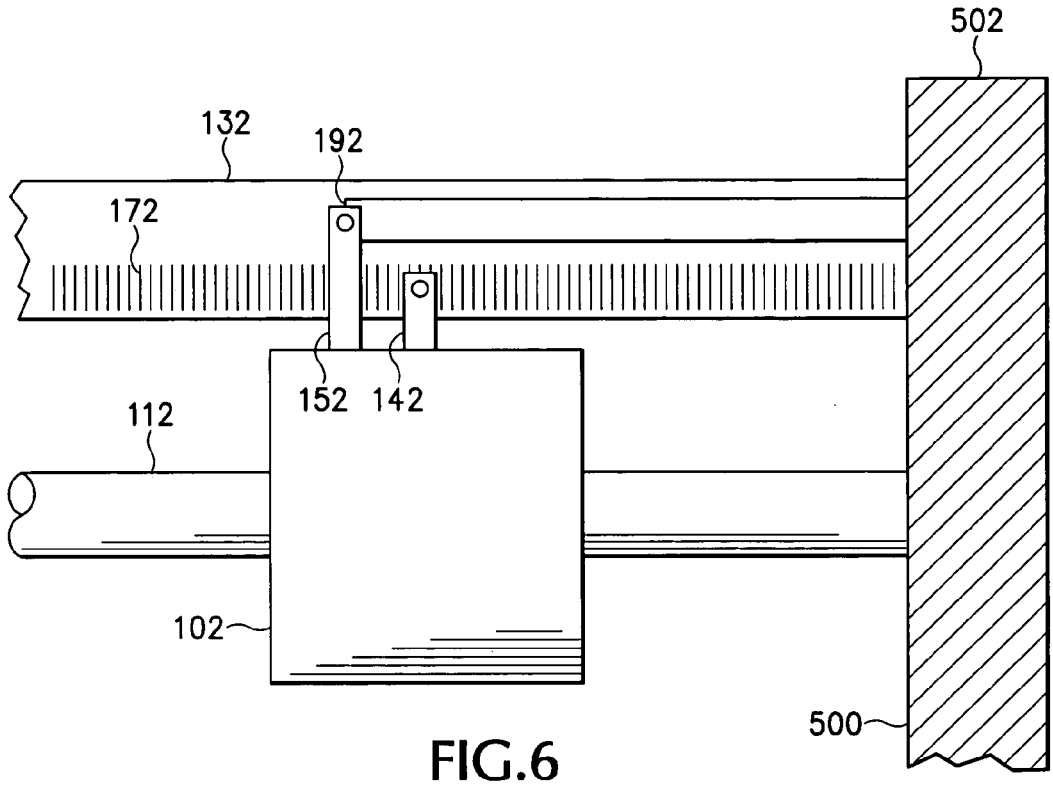
FIG. 6 illustrates a carriage at a home position, according to an example embodiment.

Next, pursuant to block 404 of FIG. 4, the controller 160 moves the carriage 102 away from the hard stop position until detecting the light-to-dark transition 192 (FIG. 3), which indicates a home position for the carriage 102. The light-to-dark transition 192 may be referred to as a "homing mark." However, other suitable homing marks may be alternatively employed. The controller 160 detects the homing mark based on the output of the sensor 152. The position of the carriage 102 when the sensor 152 detects the light-to-dark transition 192 is referred to as the home position. FIG. 6 illustrates the carriage 102 at the home position.

As the carriage 102 moves from the hard stop position shown in FIG. 5 to the home position shown in FIG. 6, the sensor 142 detects a number of the encoder marks 172. This number of encoder marks is a value that is indicative of the position of the carriage 102 relative to the hard stop position. Pursuant to block 406 (FIG. 4), the controller 160 (FIG. 1) stores this value in the non-volatile memory 166 (FIG. 1) for later reference. In some embodiments, before storing this value in the non-volatile memory, the controller 160 checks this value by determining whether the value is within a predetermined range of values for this position. If the value is within the predetermined range, the controller 160 proceeds with storing the value in the non-volatile memory 166 as a value indicative of the position of the carriage 102 at the home position. Else, the controller 160 performs the actions of blocks 402 and 404 again.

The method described above and illustrates in FIGS. 4-6 is also performed for the carriage 104 (FIG. 1).

According to some embodiments, the controller 160 performs a print/scan alignment procedure to align the carriages 102, 104 based on the home positions of the carriages 102, 104. This print/scan alignment procedure may be performed after block 406 of FIG. 4.

After a power cycle, or at other times, the system 100 (FIG. 1) may determine the location of the carriages 102, 104. The controller 160 (FIG. 1) may determine the positions of the carriages 102, 104 and find the home positions for each of the carriages according to the method shown in FIG. 7 and described below.

Figure 7:
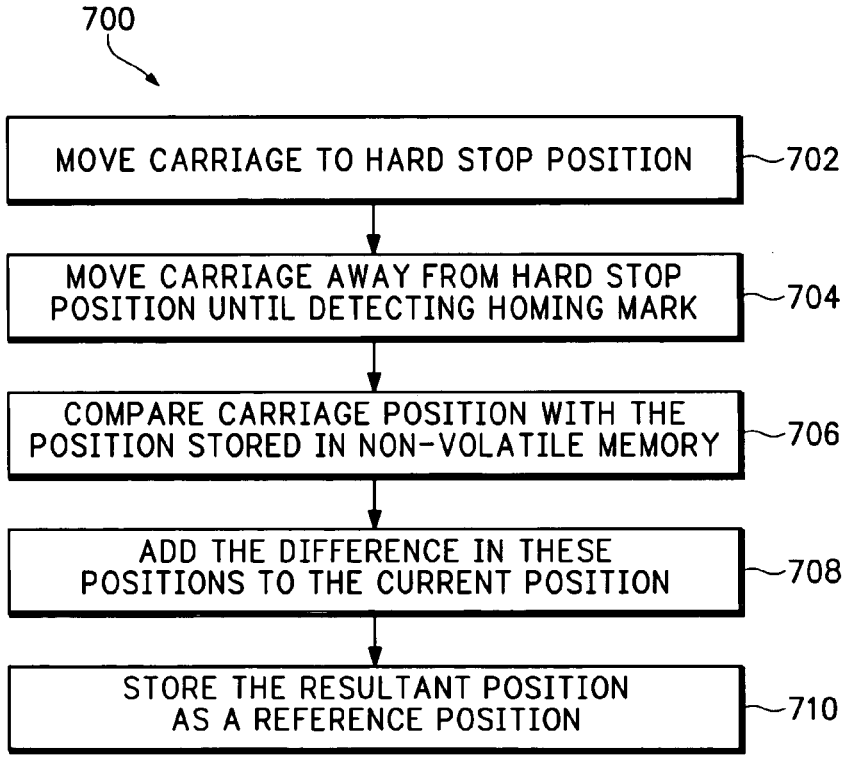
FIG. 7 is a flowchart illustrating a method for finding the home position.

FIG. 7 illustrates a flowchart 700 that may be performed after a power cycle or at a user-specified time. After a power cycle, the controller 160 (FIG. 1) may not have an accurate indicator as to the location of the carriages 102, 104. As such, pursuant to block 702, the controller 160 moves the carriage 102 to the hard stop position shown in FIG. 5. In particular, the controller 160 moves the carriage 102 toward the surface 500 (FIG. 5) of the wall 502 until the surface 504 of the carriage 102 contacts the wall 502, thus stopping movement of the carriage 102 in that direction. The location of the carriage 102 when the carriage surface 504 contacts the wall surface 500 is the hard stop position for the carriage 102.

Next, pursuant to block 704, the controller 160 moves the carriage 102 away from the hard stop position until detecting the light-to-dark transition 192 (FIG. 3), which indicates a home position for the carriage 102. As mentioned above, the light-to-dark transition 192 may be referred to as a "homing mark." The controller 160 detects the homing mark based on the output of the sensor 152. The position of the carriage 102 when the sensor 152 detects the light-to-dark transition 192 is referred to as the home position. FIG. 6 illustrates the carriage 102 at the home position.

As the carriage 102 moves from the hard stop position shown in FIG. 5 to the home position shown in FIG. 6, the sensor 142 detects a number of the encoder marks 172. This number of encoder marks is a value that is indicative of the position of the carriage 102 relative to the hard stop position of block 702. This value may not be the same as the value stored in the non-volatile memory 166 due to factors such as location tolerances of the various mechanical and electrical components.

At block 706, the controller 160 compares the value indicative of the position of the carriage 102 with the value stored in non-volatile memory for the carriage 102 and determines a difference between these two values. At block 708, the controller 160 adds this difference to the value indicative of the position of the carriage 102. The resultant value is then stored as the home position for carriage 102, pursuant to block 710.

This process may also be performed for the carriage 104 to obtain a new home position for the carriage 104.

In this manner the controller 160 can accurately position the carriages 102, 104 at home positions that are acceptably close to the home positions determined before the power cycle in an efficient manner.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. An apparatus, comprising:

a carriage having first and second sensors, the carriage movable along an axis;

an encoder strip having a series of substantially equally spaced first markings and at least one second marking having a width greater than a width of one of the first markings, the first markings aligned with the first sensor for detection by the first sensor and the second marking aligned with the second sensor for detection by the second sensor;

a controller configured to receive information from the first and second sensors and to determine position information based on the information received from the first and second sensors;

a non-volatile memory, the controller configured to store the position information in the non-volatile memory.

2. An apparatus, comprising:

a carriage having first and second sensors, the carriage movable along an axis;

an encoder strip having a series of substantially equally spaced first markings and at least one second marking having a width greater than a width of one of the first markings, the first markings aligned with the first sensor for detection by the first sensor and the second marking aligned with the second sensor for detection by the second sensor;

a controller configured to receive information from the first and second sensors and to determine position information based on the information received from the first and second sensors;

a non-volatile memory, the controller configured to store the position information in the non-volatile memory, wherein the controller is configured to obtain the position information from the non-volatile memory after a power cycle.

3. An apparatus, comprising:

a carriage having first and second sensors, the carriage movable along an axis;

an encoder strip having a series of substantially equally spaced first markings and at least one second marking having a width greater than a width of one of the first markings, the first markings aligned with the first sensor for detection by the first sensor and the second marking aligned with the second sensor for detection by the second sensor;

a second carriage having second carriage sensors, the second carriage configured to support one or more inkjet pens;

a second encoder strip having markings detectable by the second carriage;

a controller configured to receive information from the first and second sensors and to determine position information based on the information received from the first and second sensors;

a non-volatile memory, the controller configured to store the position information in the non-volatile memory.

4. The apparatus of claim 2, the carriage having one or more inkjet pens positioned thereon.

5. The apparatus of claim 2, wherein the second sensor comprises an opto-interrupter sensor.

6. The apparatus of claim 2, further comprising a third sensor configured to detect markings on a print medium carried by a drum.

7. The apparatus of claim 1, wherein the width of the second marking is more than 100 times the width of one of the first markings.

8. The apparatus of claim 1, wherein the first markings include a set of light-to-dark transitions and the second marking includes a single light-to-dark transition.

9. The apparatus of claim 1, wherein the first markings include individual markings formed on the encoder strip and the second marking includes a single marking formed on the encoder strip.

10. The apparatus of claim 1, wherein an end of the second marking indicates a home position for the carriage.

11. The apparatus of claim 10, wherein the end of the second marking is spaced from a surface forming a hard stop position for the carriage, and the second marking extends from the surface to the end.

12. The apparatus of claim 11, wherein the controller is configured to move the carriage to the hard stop position, move the carriage away from the hard stop position to the home position, detect a number of the first markings as the carriage moves from the hard stop position to the home position, and store the number in the non-volatile memory as a position of the carriage at the home position.

13. The apparatus of claim 2, wherein the width of the second marking is more than 100 times the width of one of the first markings.

14. The apparatus of claim 2, wherein the first markings include a set of light-to-dark transitions and the second marking includes a single light-to-dark transition.

15. The apparatus of claim 2, wherein the first markings include individual markings formed on the encoder strip and the second marking includes a continuous marking formed on the encoder strip.

16. The apparatus of claim 2, wherein the second marking extends from a surface forming a hard stop position for the carriage to an end spaced from the surface indicating a home position for the carriage.

17. The apparatus of claim 16, wherein, after the power cycle, the controller is configured to move the carriage to the hard stop position, move the carriage away from the hard stop position to the home position, detect a number of the first markings as the carriage moves from the hard stop position to the home position, determine a difference between an existing value stored in the non-volatile memory indicative of a position of the carriage at the home position and the number, add the difference to the number to establish a resultant value, and store the resultant value in the non-volatile memory as a new position of the carriage at the home position.

18. The apparatus of claim 3, wherein the width of the second marking is more than 100 times the width of one of the first markings.

19. The apparatus of claim 3, wherein the first markings include a set of light-to-dark transitions and the second marking includes a single light-to-dark transition.

20. The apparatus of claim 3, wherein the first markings include individual markings formed on the encoder strip and the second marking includes a single marking formed on the encoder strip.

* * * * *

UNITED STATES PATENT AND TRADEMARK OFFICE

CERTIFICATE OF CORRECTION

PATENT NO. : 7,654,629 B2
APPLICATION NO. : 11/494214
DATED : February 2, 2010
INVENTOR(S) : Jason C. Grosse et al.

It is certified that error appears in the above-identified patent and that said Letters Patent is hereby corrected as shown below:

In column 6, line 66, in Claim 15, delete "continuous" and insert -- single --, therefor.

Signed and Sealed this

Twentieth Day of July, 2010

David J. Kappos

David J. Kappos
*Director of the United States Patent and Trademark Office*